US006978849B2

(12) United States Patent
Sherwood

(10) Patent No.: US 6,978,849 B2
(45) Date of Patent: Dec. 27, 2005

(54) HOLE-BORING METHOD AND SYSTEM FOR MAKING CAST-IN-SITU PILES

(75) Inventor: David Sherwood, Nanterre (FR)

(73) Assignee: Compagnie du Sol, Nanterre (FR)

( * ) Notice: Subject to any disclaimer, the term of this patent is extended or adjusted under 35 U.S.C. 154(b) by 163 days.

(21) Appl. No.: 10/271,880

(22) Filed: Oct. 15, 2002

(65) Prior Publication Data

US 2003/0089525 A1 May 15, 2003

(30) Foreign Application Priority Data

Oct. 24, 2001 (FR) ..... 01 13717

(51) Int. Cl.[7] ..... E21B 7/26
(52) U.S. Cl. ..... 175/57; 175/19; 175/323
(58) Field of Search ..... 175/57, 394, 323, 175/406, 395, 407, 19, 20, 21, 257; 405/232, 244

(56) References Cited

U.S. PATENT DOCUMENTS 3,470,701 A * 10/1969 Turzillo ..... 405/233
3,690,109 A * 9/1972 Lee ..... 405/241
5,919,005 A * 7/1999 Rupiper ..... 405/244
6,641,332 B1 * 11/2003 Alvarado ..... 405/232

FOREIGN PATENT DOCUMENTS

| | | |
|---|---|---|
| EP | 0 853 162 | 7/1998 |
| EP | 1 132 525 | 9/2001 |
| FR | 2 566 813 | 1/1986 |
| GB | 1 391 109 | 4/1975 |

* cited by examiner

*Primary Examiner*—Kenn Thompson
(74) *Attorney, Agent, or Firm*—Merchant & Gould P.C.

(57) ABSTRACT

The invention relates to a method of boring a hole using a boring system constituted by a simple auger and a dip tube slidably mounted in said auger, said dip tube being provided at its bottom end with a tool. The method comprises the following steps:

causing said auger and said dip tube to descend and to rotate simultaneously, said tool on the dip tube being substantially level with the bottom end of the auger;

interrupting the descent and rotation of said auger so that the auger constitutes anchor means for anchoring the boring system in the ground; and causing the dip tube to descend and rotate on its own, whereby the tool of the dip tube performs boring by displacing ground at the bottom end of the borehole, thereby compacting the ground.

8 Claims, 3 Drawing Sheets

HOLE-BORING METHOD AND SYSTEM FOR MAKING CAST-IN-SITU PILES

The present invention relates to a hole-boring method and system, in particular for making cast-in-situ piles.

BACKGROUND OF THE INVENTION

In order to make cast-in-situ piles in the ground, it is known that holes must initially be bored presenting the diameter and the depth that correspond to the pile that is to be made, after which concrete or a grout is injected into the borehole so as to make the pile.

French patent No. 2 566 813 describes an improved method of boring holes for cast-in-situ piles in which a machine is used as shown in accompanying FIG. 1. The machine comprises an assembly which is suspended from an end of a cable supported by the jib of crane. The machine has a top head 1. The top head 1 forms a bracket using a system of actuators 2 and 3 for supporting a drive head 4 for setting an auger 5 into rotation. The auger is constituted by a hollow core 6 and by a helically-shaped blade 7. The drive head 4 serves to turn the auger 5 thus enabling a hole 7' to be bored. A rigid tube referred to as a "dip" tube 9 is slidably mounted inside the hollow core 6 and the bottom end of the tube is provided with a tool 14 and with a hole 13 for injecting concrete. The top end of the tube is secured to the support bracket 1 and is connected to a hose 10 for delivering concrete via a rotary joint 15.

While boring, the dip tube is constrained to move in translation and in rotation with the auger 5, e.g. by a clutch system 12. Under such circumstances, the actuators 3 are extended so that the tool 14 is at the bottom end of the core 6 of the auger. When boring is terminated, the dip tube is separated from the auger.

In order to make the cast-in-situ pile in the hole 7', the actuators 3 are operated to raise the auger progressively relative to the dip tube 9 which is then free to turn. Thus, concrete can be injected into the borehole via the orifices 13 formed at the bottom end of the dip tube since these orifices are now outside the auger. Starting from this position in which the dip tube is offset relative to the auger, the entire dip tube and auger assembly can be raised using the crane so as to allow the borehole to be filled completely with concrete or grout.

That technique of making cast-in-situ piles suffers from the drawback of not enabling the quality of the boring to be controlled effectively, in particular the quality of the walls of the borehole and specifically the quality of the bottom end of the borehole. Unfortunately, the quality and the mechanical strength of the pile depend specifically on the excavated material that comes from making the borehole not being mixed with the concrete or grout while it is being injected into the borehole.

OBJECTS AND SUMMARY OF THE INVENTION

An object of the present invention is to provide a boring system which enables a borehole to be made for making a cast-in-situ pile that presents improved qualities, in particular better control over the quality of the walls of the borehole, and in particular of the bottom end thereof.

To achieve this end, the invention provides a method of boring a hole using a boring system constituted by a simple auger and a dip tube slidably mounted in said auger, said dip tube being provided at its bottom end with at least one injection hole and with a boring tool, the method comprising the following steps:

- causing said auger and said dip tube to descend and to rotate simultaneously, said tool of the dip tube being substantially level with the bottom end of the auger;
- interrupting descent and rotation of said auger so that the auger constitutes means for anchoring the boring system in the ground; and
- causing the dip tube alone to descend and to rotate, whereby the rotation and descent of the tool on the dip tube perform boring by displacing the ground at the bottom end of the borehole, with the ground in which the hole is bored being compacted.

It will be understood that once the main portion of the borehole has been bored using the auger, the bottom of the borehole is made using only the tool on the dip tube which operates by displacement and which thus compacts effectively the ground at the bottom end of the hole, thereby making it possible to ensure that the bottom end of the resulting cast-in-situ pile is of very good quality.

In a preferred implementation, firstly the diameter of the hollow core of the auger is selected relative to the outside diameter of the blade in appropriate manner and secondly the rate of descent and the speed of rotation of the auger are controlled so that, while the auger is in use, a ground displacement effect is obtained at least in part, thereby ensuring better-quality compacting of the wall of the borehole along its main portion.

The invention also provides a system for boring a hole in the ground, the system comprising an auger having a hollow core and at least one blade in the form of a helix extending substantially along its entire length, the outside diameter D1 of the core of the auger and the outside diameter D2 of said blade being such that the ratio of the areas of the corresponding circles lies in the range 25% to 75%, a dip tube provided at its bottom end with a tool, said tube being movably received in the hollow core of the auger, vertical guide means, and means for setting said auger into rotation, said means being movable along said guide means, said system further comprising:

- connection means that are controllable in translation and rotation between the dip tube and the auger so as to enable the tool of the dip tube to be substantially level with the bottom end of said auger;
- means for causing said dip tube to move vertically relative to said auger so that the tool of the dip tube projects beyond the bottom end of the auger; and
- means for setting said dip tube into rotation on its own.

BRIEF DESCRIPTION OF THE DRAWINGS

Other characteristics and advantages of the invention will appear better on reading the following description of a preferred embodiment of the invention given by way of non-limiting example. The description refers to the accompanying figures, in which.

MORE DETAILED DESCRIPTION

Figure 1:
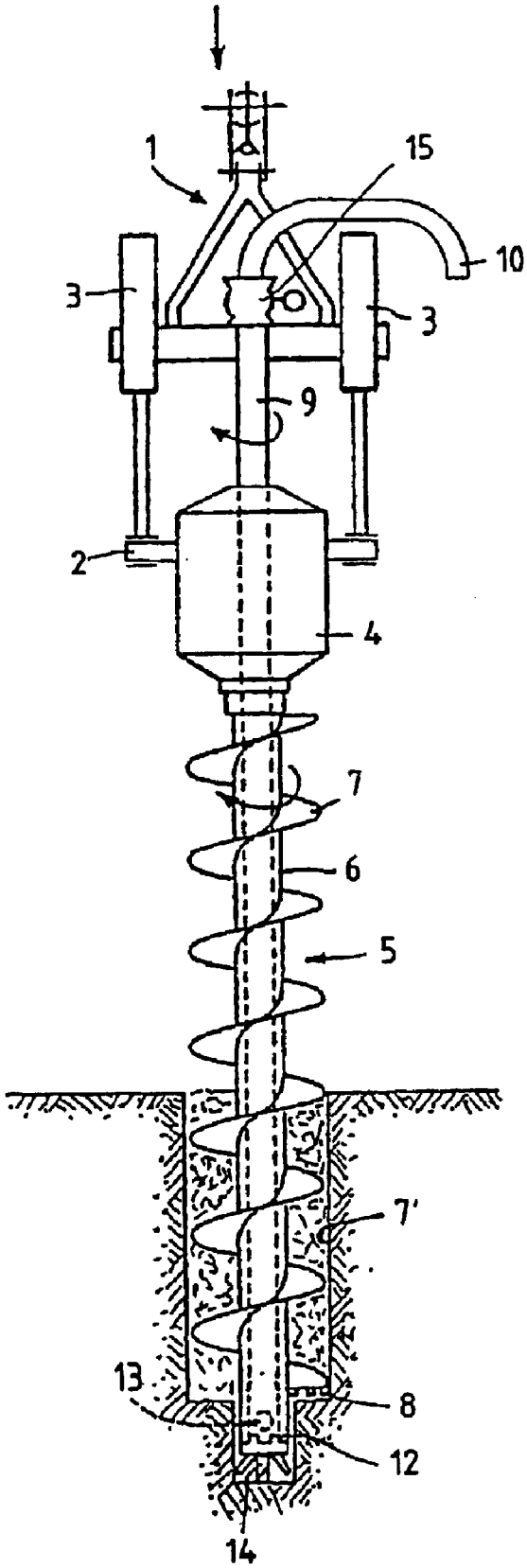
FIG. 1, described above, shows a known boring system for making cast-in-situ piles.
Figure 2:
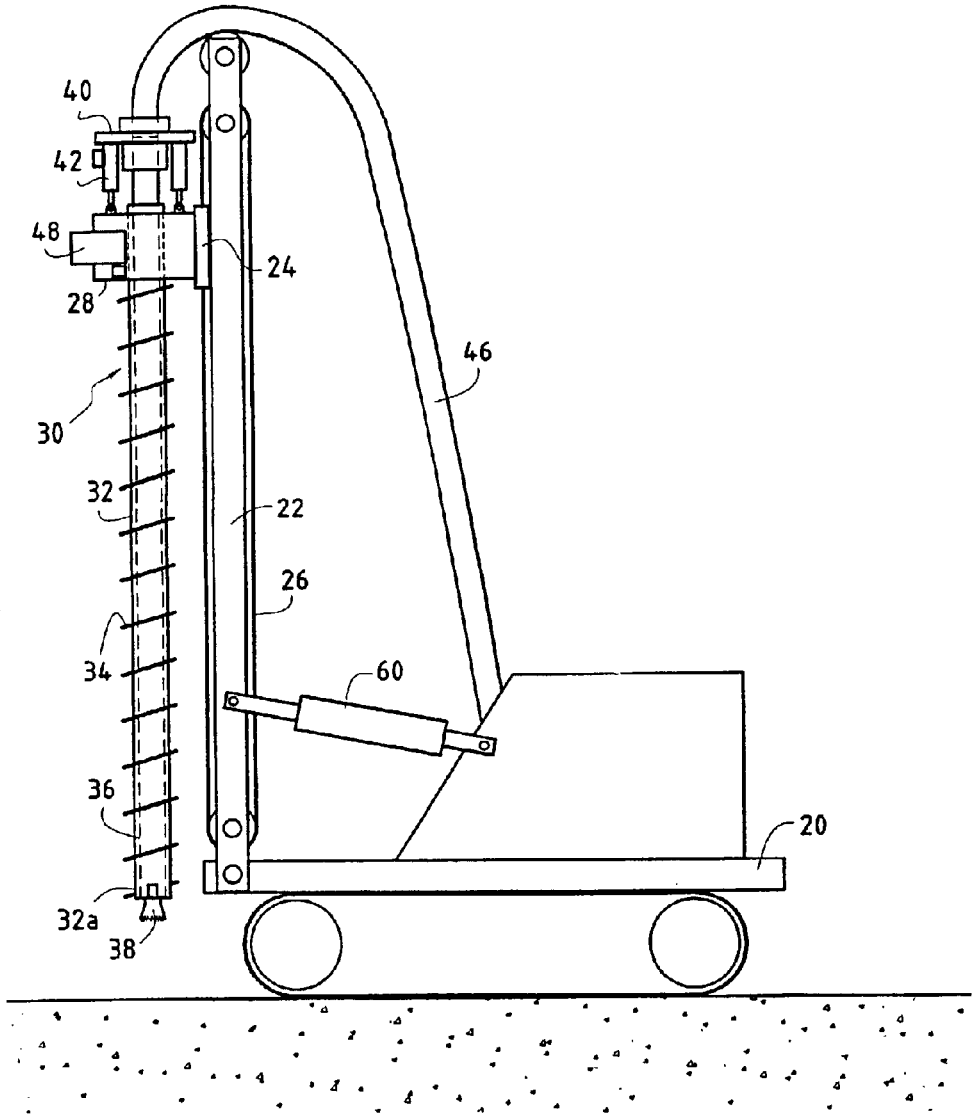
FIG. 2 is an overall view of a boring system of the invention.
Figure 2A:
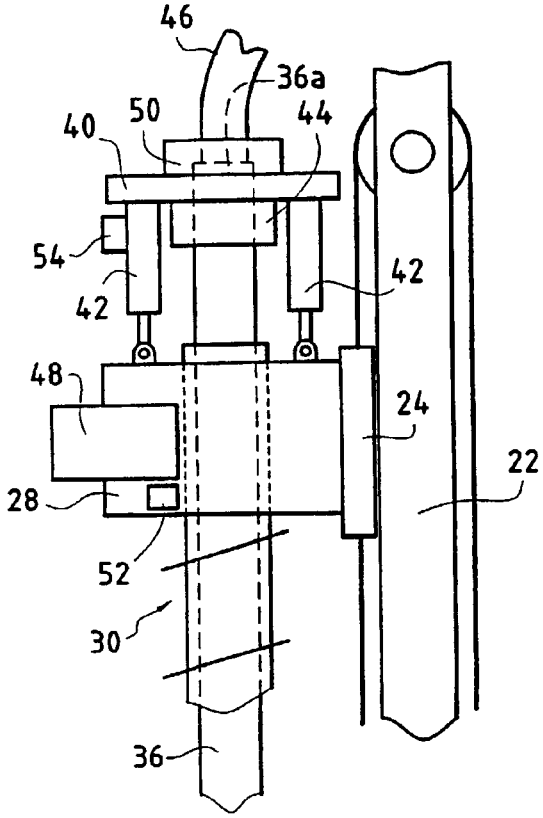
FIG. 2A is a view of the top portion of the boring system.

With reference initially to FIGS. 2 and 2A, there follows a description of a preferred embodiment of the boring system for making holes for cast-in-situ piles.

The system comprises a platform 20 having a guide mast 22 mounted thereon, which mast occupies a vertical position when in use. A carriage 24 is mounted to move vertically on the mast so as to be displaced by cables 26 associated with a motor (not shown). The carriage 24 carries a drilling head 28 suitable for driving a hollow-cored vertical auger 30 in rotation, said auger having a hollow core 32 and at least one helical blade 34 extending substantially along the entire length of the core. Inside the hollow core 32 of the auger 30 there is freely mounted a rigid dip tube 36 that is likewise hollow and that has a bottom end fitted with a tool 38 that projects beyond the bottom end 32*a* of the core of the auger. A moving plate 40 is connected to the drilling head 28 via vertical actuators 42. As shown better in FIG. 2A, this plate 40 receives the top end 36*a* of the dip tube 36 and carries a motor 44 for setting the top end of the dip tube into rotation. The top end 36*a* of the dip tube is connected to a flexible hose 46 for feeding it with concrete or grout via a rotary joint.

As shown in FIG. 2A, the drilling head 28 comprises in particular a motor 48 for setting the auger 30 into rotation. In addition, a rotary joint 50 provides a connection through the plate 40 between the top end of the dip tube 36 and the flexible hose 46. The drilling head 28 is also fitted with a detector 52 for measuring the actual speed of rotation of the auger. There can also be seen a pressure detector 54 associated with the actuators 42 which connect the drilling head 28 to the plate 40. It will be understood that the actuators 42 enable the position of the dip tube 36 relative to the auger to be modified. In addition, the cable 26 for moving the drilling head 28 vertically or the motor for driving said cable is associated with a linear displacement sensor 60 for measuring the actual vertical displacement of the auger.

Figure 3:
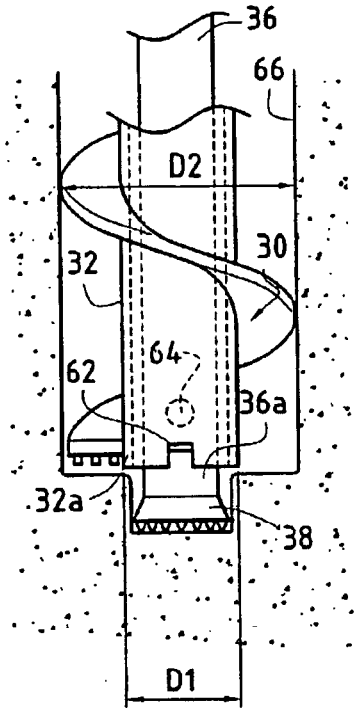
FIG. 3 is a fragmentary view showing the bottom portion of the auger and of the dip tube while making the main portion of the borehole.

FIG. 3 shows the relative position of the bottom end 32*a* of the auger and the bottom end 36*a* of the dip tube fitted with its tool 38. While boring the main part of the borehole, the dip tube 36 and the auger 32 are constrained to rotate together, e.g. by a clutch system 62, and the concrete injection orifices 64 of the dip tube are thus masked by the core of the auger. During this stage, it will be understood that the actuators 42 are in the extended position such that the tool 38 carried by the dip tube is substantially level with the bottom end 32*a* of the auger, and the injection holes 64 are masked by the auger. During this stage, because of the presence of the sensors that sense the speed of rotation of the auger and its vertical rate of displacement, it is possible to control the downward speed and the speed of rotation of the auger so that it operates at least partially in a mode in which it displaces ground during boring of the hole 66. This ensures that the walls of the borehole are thoroughly compacted.

Figure 4:
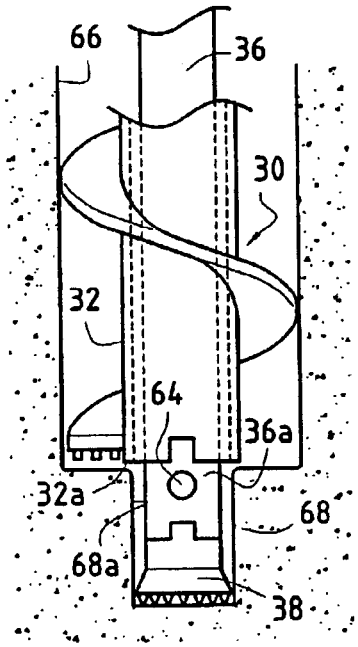
FIG. 4 shows the bottom end of the auger and of the dip tube while making the end portion of the borehole.

When the auger reaches the bottom end of the main portion of the borehole, as shown in FIG. 4, rotation and descent of the auger are stopped, i.e. the drilling head 28 is stopped and the actuators 42 are operated so as to lower the dip tube 36 relative to the auger. It will be understood that in this position, with the auger stationary, its blade(s) constitute means for effectively anchoring the auger relative to the ground. The action of the actuators 42 can be combined with turning of the auxiliary rotation head 44 so as to enable the tool 38 at the end of the dip tube to be lowered progressively. This descent serves to bore an extension 68 to the main portion 66 of the borehole. This descent of the dip tube together with its tool 68 gives rise to a ground displacement phenomenon which is accompanied by the wall 68*a* in the borehole extension being compacted. This ensures that the wall presents good mechanical strength properties.

In this position, it is then possible to inject grout or concrete via the dip tube 38 which is fed via the flexible hose 46, while simultaneously raising the auger and the dip tube by raising the drilling head 28, the actuators 42 then being maintained in their preceding position. It is thus possible to inject concrete and grout through the injection holes 64 of the dip tube under good conditions since raising the auger without turning it serves to raise the excavated material that results from boring the main portion of the borehole 66, thus eliminating any risk of excavated material being mixed with the injected concrete or grout. The dip tube is itself preferably driven in rotation during this operation.

The actuators 42 are preferably fitted with a sensor 54 for sensing the pressure of the control fluid. Measuring this pressure gives information concerning the nature of the ground at the bottom end 68 of the borehole when the actuators are operated to move the dip tube downwards while the auger remains stationary.

Also preferably, the outside diameter D1 of the core of the auger and the outside diameter D2 of the blade are given values such that the ratio of the areas of the corresponding circles lies in the range 25% to 75%. This selection makes it possible to use the auger to obtain a significant displacement effect as soon as the rate of descent of the auger is properly correlated with its speed of rotation. It will be understood that the bottom end of the hollow core of the auger is, in addition, closed by the tool 38 mounted at the bottom end of the dip tube.

What is claimed is:

1. A method of boring a hole using a boring system constituted by a simple auger and a dip tube slidably mounted in said auger, said dip tube having no outside helical blade and at least one injection hole and a boring tool at a bottom end of the dip tube, the method comprising the following steps:

causing said auger and said dip tube to descend and to rotate simultaneously, said boring tool of the dip tube being substantially level with the bottom end of the auger;

interrupting descent and rotation of said auger so that the auger constitutes means for anchoring the boring system in the ground; and simultaneously causing the dip tube alone to descend and to rotate, whereby the rotation and descent of the boring tool on the dip tube perform boring by displacing the ground at the bottom end of the borehole, with the ground in which the hole is bored being compacted.

2. A method according to claim 1, wherein said auger has a hollow core and at least one blade in the form of a helix extending substantially along the entire length of the core, the outside diameter D1 of the core and the outside diameter D2 of the blade being such that the ratio between the areas of the corresponding circles lies in the range 25% to 75%.

3. A method according to claim 2, wherein the rate of descent of the auger and its speed of rotation are controlled so that the auger produces a displacement effect on the ground during boring.

4. A method according to claim 1, wherein the force needed to cause the boring tool on the dip tube to move down once the auger is stationary is measured, thereby obtaining information concerning the nature of the ground at the bottom end of the borehole.

5. A system for boring a hole in the ground, the system comprising an auger having a hollow core and at least one blade in the form of a helix extending substantially along its entire length, the outside diameter D1 of the core of the auger and the outside diameter D2 of said blade being such that the ratio of the areas of the corresponding circles lies in the range 25% to 75%, a dip tube provided at its bottom end with a tool, said tube being movably received in the hollow core of the auger, vertical guide means, and means for setting said auger into rotation, said means being movable along said guide means, said system further comprising:

connection means that are controllable in translation and rotation between the dip tube and the auger so as to enable the tool of the dip tube to be substantially level with the bottom end of said auger;

means for causing said dip tube to move vertically relative to said auger so that the tool of the dip tube projects beyond the bottom end of the auger; and means for setting said dip tube into rotation on its own.

6. A boring system according to claim 6, further comprising means for measuring the actual rate of descent of said auger, means for measuring the actual speed of rotation of the auger, and means for controlling the means for setting the auger into rotation and the means for lowering said auger so as to obtain at least in part an effect of displacing the ground in which the hole is bored.

7. A boring system according to claim 6, further comprising means for measuring the force applied to the dip tube to cause it to descend relative to the auger when the auger is stationary.

8. A method of making a cast-in pile in the ground using a boring system constituted by a simple auger and a dip tube slidably mounted in said auger, said dip tube having no outside helical blade and being provided at its bottom end with at least one injection hole and with a boring tool, the method comprising the steps of:

causing said auger and said dip tube to descend and to rotate simultaneously, said boring tool of the dip tube being substantially level with the bottom end of the auger;

interrupting descent and rotation of said auger so that the auger constitutes means for anchoring the boring system in the ground;

simultaneously causing the dip tube alone to descend and to rotate, whereby the rotation and descent of said boring tool on the dip tube perform boring by displacing the ground at the bottom end of the borehole, with the ground in which the hole is bored being compacted;

maintaining the vertical relative position of said auger and said dip tube so that said at least one injection hole of the dip tube is located outside said auger;

feeding said dip tube with the material necessary to make said pile so that said material is injected into said borehole through said at least one injection hole of the dip tube; and moving upwardly said auger and said dip tube while maintaining said vertical relative position thereof.

* * * * *